US005941293A

United States Patent [19]

Serpa

[11] Patent Number: 5,941,293

[45] Date of Patent: Aug. 24, 1999

[54] GOLF CLUB COVER WITH APERTURE

[76] Inventor: Michael Lawrence Serpa, P.O. Box 2693, Newport Beach, Calif. 92659

[21] Appl. No.: 09/027,240

[22] Filed: Feb. 20, 1998

[51] Int. Cl.[6] ..... A63B 57/00

[52] U.S. Cl. ..... 150/160; 206/315.4

[58] Field of Search ..... 150/159, 160; 206/315.2, 315.4

[56] References Cited

U.S. PATENT DOCUMENTS

| | | | |
|---|---|---|---|
| Re. 35,596 | 8/1997 | Diener et al. . | |
| 3,426,815 | 2/1969 | Ashlin et al. . | |
| 3,478,799 | 11/1969 | Hoyt, Jr. . | |
| 3,574,963 | 4/1971 | Rosenow . | |
| 3,593,769 | 7/1971 | Spears . | |
| 3,645,022 | 2/1972 | Anderson . | |
| 3,667,078 | 6/1972 | Distasio | 206/315.4 X |
| 4,119,129 | 10/1978 | Freiberg . | |
| 4,605,050 | 8/1986 | Suk . | |
| 4,898,222 | 2/1990 | Gaffney . | |
| 4,971,126 | 11/1990 | Borenstein . | |
| 4,991,338 | 2/1991 | Jones . | |
| 5,005,624 | 4/1991 | Sung | 206/315.4 X |
| 5,050,655 | 9/1991 | Borenstein . | |
| 5,117,884 | 6/1992 | Diener et al. | 206/315.4 X |
| 5,195,568 | 3/1993 | Cirone . | |
| 5,294,127 | 3/1994 | Keelan . | |
| 5,415,213 | 5/1995 | Diener et al. . | |
| 5,547,193 | 8/1996 | Sander . | |
| 5,611,379 | 3/1997 | Hoyt et al. | 206/315.4 X |
| 5,735,327 | 4/1998 | Aldcroft et al. | 206/315.4 X |

FOREIGN PATENT DOCUMENTS

| | | | |
|---|---|---|---|
| 261329 | 5/1965 | Australia | 206/315.2 |
| 1360058 | 7/1974 | United Kingdom | 206/315.2 |

*Primary Examiner*—Sue A. Weaver

[57] ABSTRACT

A golf club head cover (20) that includes an uncovered aperture (21) for viewing club head identification markings. A slot (22) permits passage of the club head into and out of the cover (20). Part of the cover (20) protects the neck of the club head. The slot (22) runs down the side of the neck that is substantially opposite the face of the club head to prevent distortion of the slot (22) as clubs of different loft angles are enclosed within the cover (20).

3 Claims, 5 Drawing Sheets

GOLF CLUB COVER WITH APERTURE

FIELD OF THE INVENTION

This invention relates to an improved removable cover for protecting the heads of golf clubs.

DISCUSSION OF PRIOR. ART

Various covers have been developed for protecting the heads of golf clubs. Competing designs reflect tradeoffs among the goals of providing a cover that adequately protects the club head, remains securely in place, and can be quickly and easily placed on and removed from the club head. Satisfying these conflicting goals is made even more difficult due to the inherent differences in size, shape, and loft of various clubs within a set and between sets offered by different manufacturers. Furthermore, the development of the so-called "oversized" club has led to even greater size and shape variances.

Club head covers and related innovations have also been specifically developed to address the problem of identifying a particular club while the cover is in place. This problem exists because most previously developed covers conceal the numerical identification markings on the head of each club.

An example of a design focused exclusively on providing a means for identifying the particular club enclosed within a club head cover is Jones, U.S. Pat. No. 4,991,338 issued Feb. 12, 1991. This design provides an identification tag that attaches to a club head cover and includes a display window holding a numerical marking identifying the particular club. Aside from requiring the assembly of multiple component parts, this design has an additional disadvantage in that each identification tag can only be used with the correct corresponding club.

Rosenow, U.S. Pat. No. 3,574,963 issued Apr. 13, 1971, and Anderson, U.S. Pat. No. 3,645,022 issued Feb. 29, 1972, represent two additional designs focused on a method to identify a club that is under a cover. As with the Jones design, Rosenow and Anderson both necessitate the manufacture and assembly of multiple component parts and both result in a cover that is suitable only for one club at a time.

One final design in the category of designs focusing on identifying the golf club protected by a club head cover is Suk, U.S. Pat. No. 4,605,050 issued Aug. 12, 1986. Suk includes a hole in the cover positioned over the club head identification markings, with a transparent window covering the hole. While providing a cover that can be used with any club at a given time, the Suk design is relatively complicated to manufacture because, like the above designs, it is comprised of a number of component parts. Additionally, the transparency of the window might be affected by glare or aging from the sun, or by general wear and use.

Other club head cover designs have focused instead on methods of retaining the cover in place on the golf club. A variety of solutions have been proposed to accomplish this goal. Some designs rely on hook and loop fasteners. Both Ashlin, U.S. Pat. No. 3,426,815 issued Feb. 11, 1969, and Gaffney, U.S. Pat. No. 4,898,222 issued Feb. 6, 1990 rely on this approach. A disadvantage of this arrangement is that it requires the assembly of multiple component parts.

Cirone, U.S. Pat. No. 5,195,568 issued Mar. 23, 1993 offers a cover constructed from an elastic rubber material such as neoprene. The snug fit provided by the neoprene holds the cover in place. However, Cirone does not protect any portion of the neck of the club and, additionally, a user might find the neoprene material difficult to use.

Another design, Spears, U.S. Pat. No. 3,593,769 issued Jul. 20, 1971, uses a fastener attached to a flexible flap-like cover. This approach also might be difficult to place on, and remove from, a club. A slightly more complicated approach is offered by Borenstein, U.S. Pat. No. 5,050,655 issued Sep. 24, 1991, which requires a user to snap and unsnap the cover when using a club.

Hoyt, U.S. Pat. No. 3,478,799 issued Nov. 18, 1969 offers a one-piece molded construction, but this cover fails to protect any portion of the neck of a club. This design also necessitates custom production of the cover to precisely fit each different club.

Diener et al., U.S. Pat. No. 5,415,213 issued May 16, 1995 and reissued Aug. 26, 1997 as U.S. Pat. No. Re. 35,596, provides another one-piece molded design that holds the cover in place by employing both a restricted throat area and separate locking elements. A primary disadvantage of Diener, however, is that the cover must be produced in different shapes to function properly with different clubs. Because of its location on the cover, the restricted throat/locking element area is subject to distortion by the variations in club face angles and size. It would be difficult to produce a cover that would universally fit every club within a set, especially one that would protect a significant portion of the neck of a club, while following the Diener design.

Finally, Sander, U.S. Pat. No. 5,547,193 issued Aug. 20, 1996 provides a cover that uses a retaining mechanism focused on the shaft/neck portion of the club. Sander, however, relies upon an assembly of multiple component parts.

OBJECTS AND ADVANTAGES

Accordingly, several objects and advantages of the present invention are to provide a golf club head cover that:

- is easy to place on and remove from the club head, yet stays securely in place when required;
- protects the neck of the club as well as the face, heel, toe, back, and bottom of the club;
- can be economically manufactured using a one-piece construction without requiring the assembly of multiple component parts;
- offers a universal fit compatible with every club in a set;
- allows a user to view the numerical identification markings on a club while the cover is in place.

Several other objects and advantages of the present invention will become apparent from the ensuing description and drawings.

DRAWING FIGURES

DETAILED DESCRIPTION OF THE INVENTION (FIGS. 1–5)

The present invention provides an improved one-piece molded club head cover that innovates both in the method by which it is retained on the club head and in the way the cover permits viewing, when the cover is in place, of the identification markings on each club. The present invention also provides a universal fit such that a single club head cover will protect and remain securely in place on any club in a given set of irons.

A cover produced in accordance with the present invention permits viewing of club head identification markings by including an uncovered opening or aperture in the portion of the cover that would otherwise conceal the markings. The extension of the cover beyond the plane of the sole of the golf club head helps to protect the area left exposed by the aperture. The cover also provides a universal fit by employing a retaining device that focuses on the neck of the golf club—a portion of the club that is substantially similar in size and shape among the various clubs within a set and even among sets offered by different manufacturers. Additionally, the design of the cover not only adapts to the unique loft angle of each club, but actually uses loft angle to help hold the cover in place.

Figure 1:
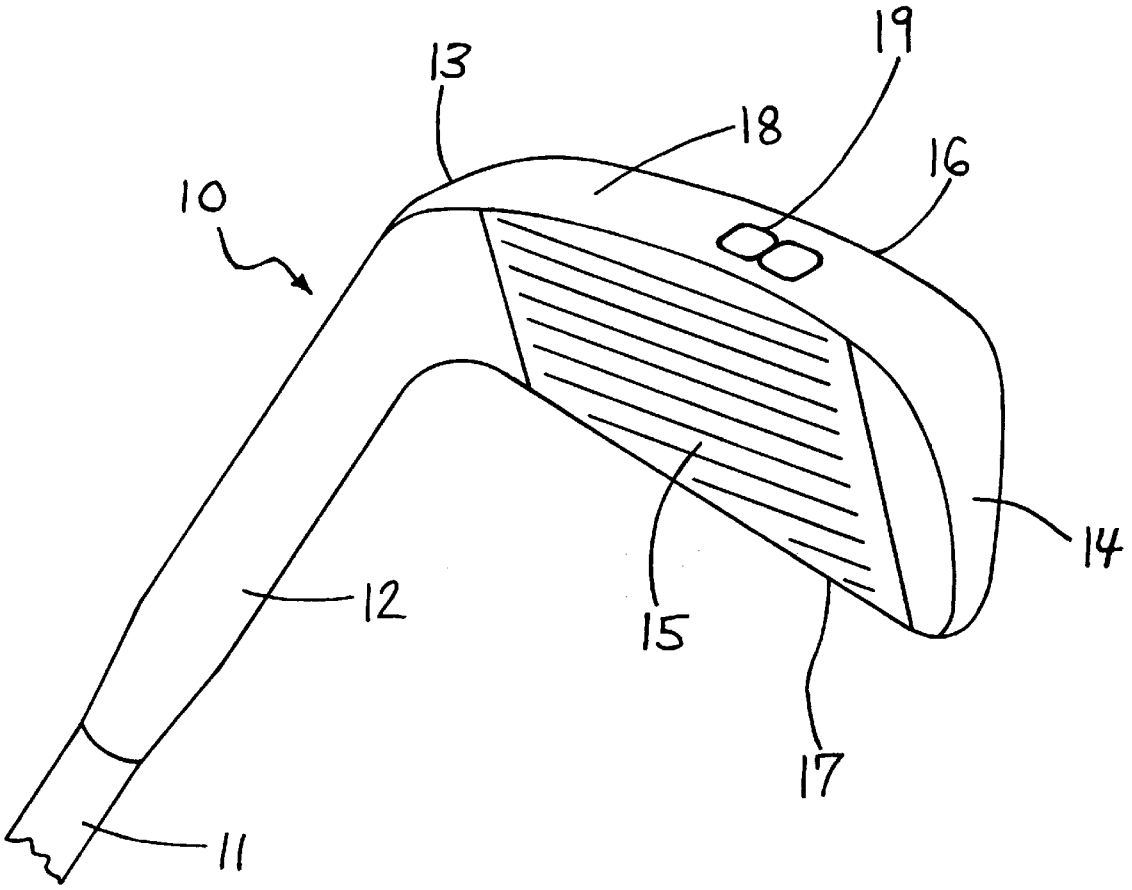
FIG. 1 is a perspective view of a golf club head.
Figure 2:
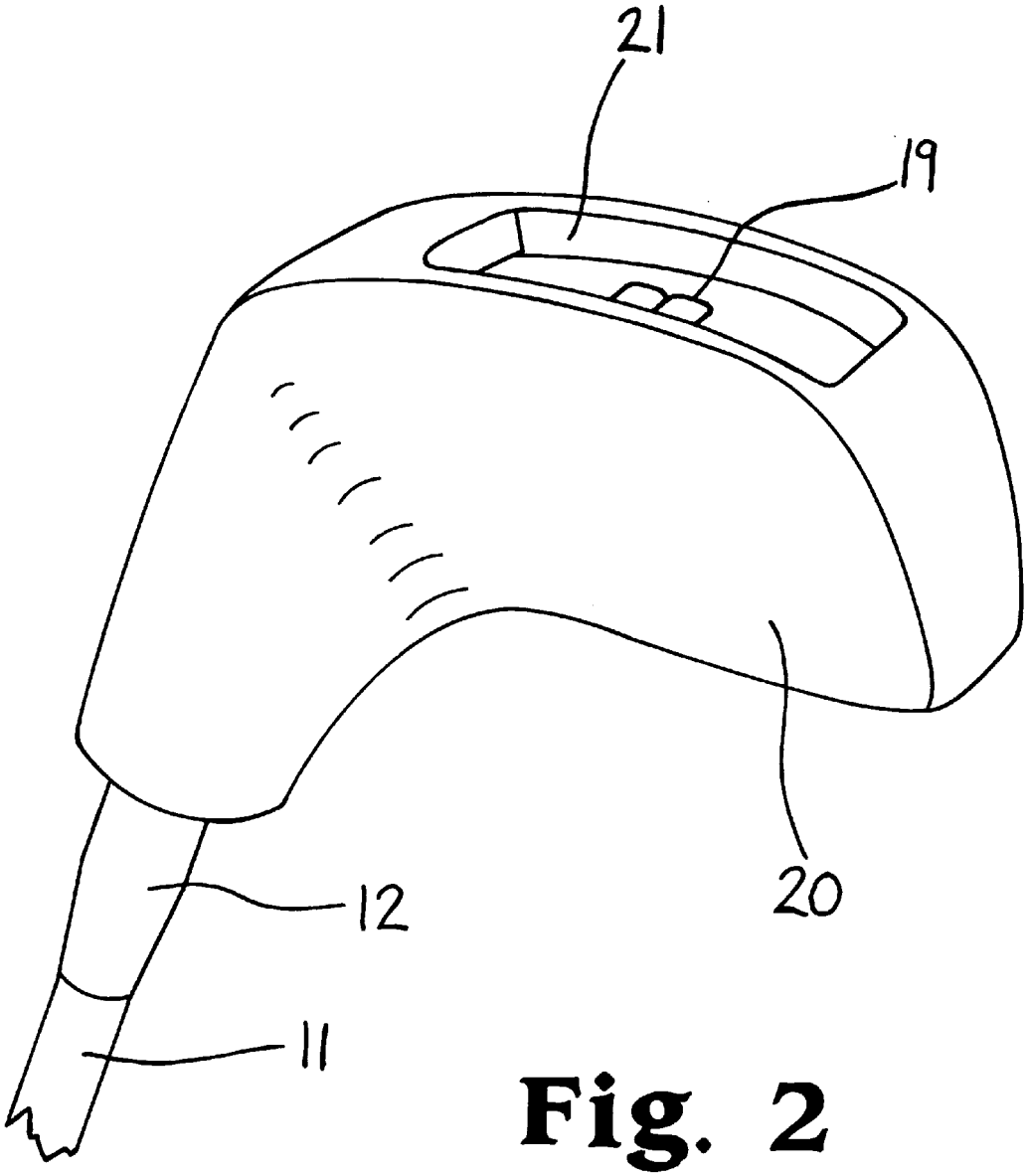
FIG. 2 is a perspective view of a cover of the present invention enclosing a golf club head.

FIG. 1 shows a golf club head 10 connected to a shaft 11. The golf club head 10 includes a neck 12, a heel 13, a toe 14, a face 15, a back 16, a top edge 17, and a sole 18. The sole 18 has an identification marking 19 to assist a user in club selection. FIG. 2 shows a view of the golf club head 10 enclosed within a cover 20 produced in accordance with the present invention.

The cover 20 can be manufactured from any suitable material, but is preferably molded in one piece from a flexible plastic. Referring to FIGS. 2 through 5, the cover 20 is a flexible hood with an inner cavity that generally conforms to the shape of, and is of sufficient size to hold, the golf club head 10. In the preferred embodiment, the cover 20 substantially, or completely, covers the face 15, the back 16, the heel 13, and the toe 14 of the golf club head 10.

The cover 20 includes an aperture 21. As shown in FIG. 2, the window aperture 21 permits viewing of the identification marking 19 when the cover 20 is on the golf club head 10. The aperture 21 does not expose any portion of the face 15 of the golf club head 10, and preferably those portions of the cover 20 concealing the face 15 and the back 16 extend beyond the plane of the sole 18 of the golf club head 10. This extension helps to protect that part of the golf club head 10 left exposed by the aperture 21.

The cover 20 also includes a slot 22 to allow passage of the golf club head 10 into and out of the cover 20. The slot 22 begins generally at that part of the cover 20 that would conceal the top edge 17 of the golf club head 10 when the cover 20 is being used. The slot continues all the way out to the part of the cover 20 that conceals the neck 12 of the golf club head 10.

Figure 3:
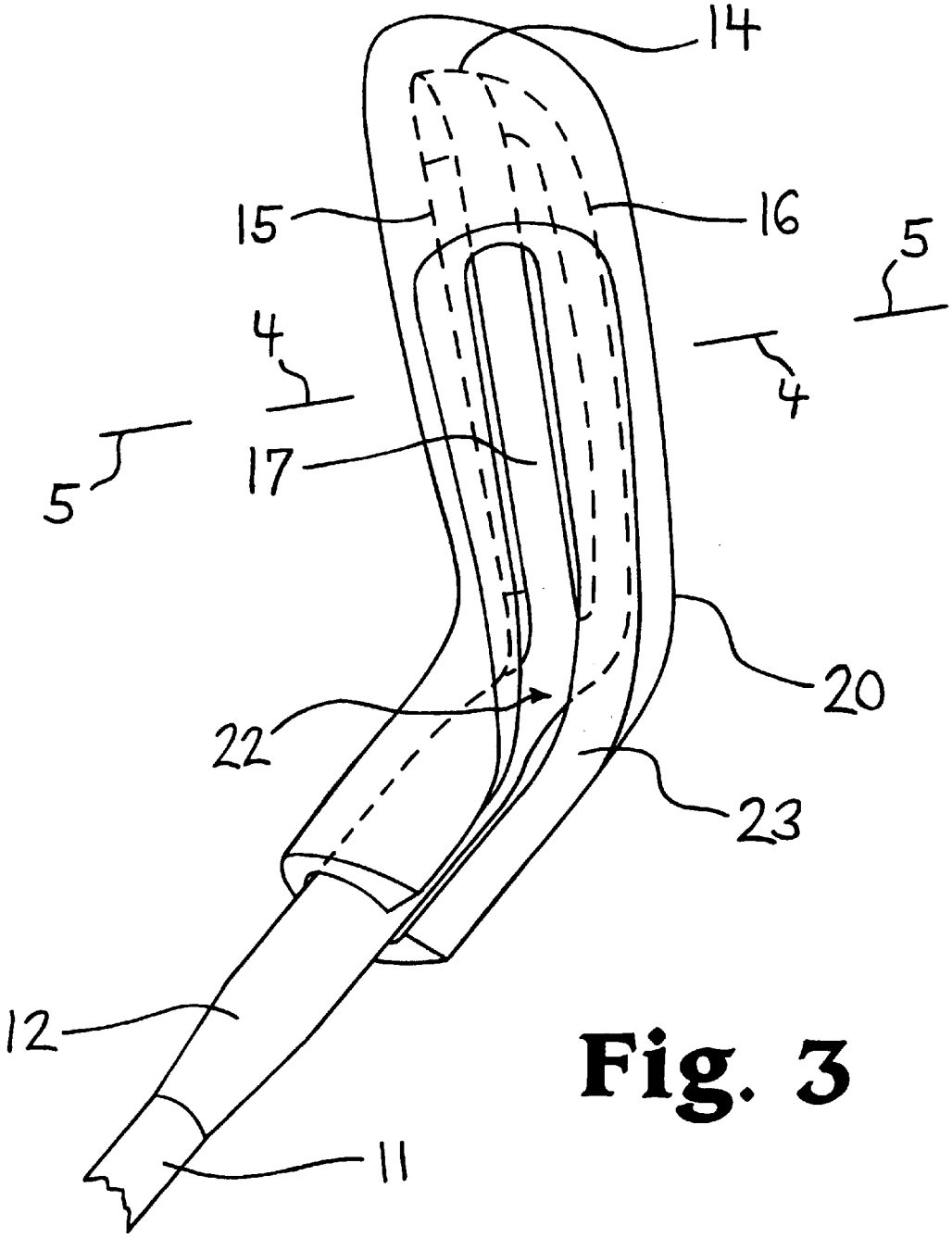
FIG. 3 is a top view of a golf club head shown by broken lines enclosed within a cover of the present invention.

Referring to FIG. 3, the slot 22 does not extend completely to the point at which the top edge 17 meets the toe 14 of the golf club head 10. This helps to keep the cover 20 in place by creating a pocket for the toe 14 end of the golf club head 10. Except at the area of the cover 20 that conceals the neck 12 of the golf club head 10, the slot need not constrict any narrower than the width of the top edge 17.

The slot 22 may include flared edges 23 along its entire length to assist a user in placing the cover 20 on a golf club.

Figure 4:
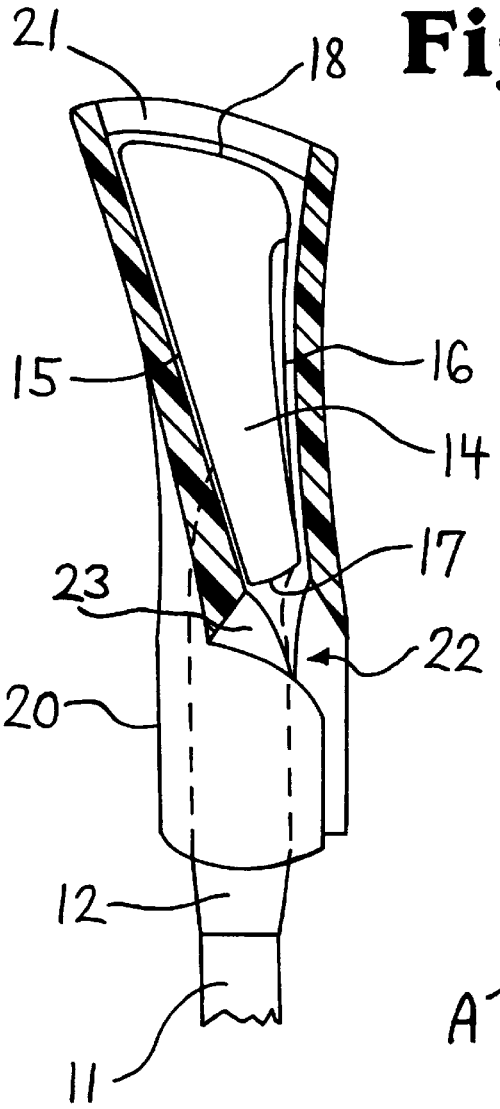
FIG. 4 is an elevation view of a low-loft golf club enclosed within a cover of the present invention with the cover cut away along line 4—4 of FIG. 3.
Figure 5:
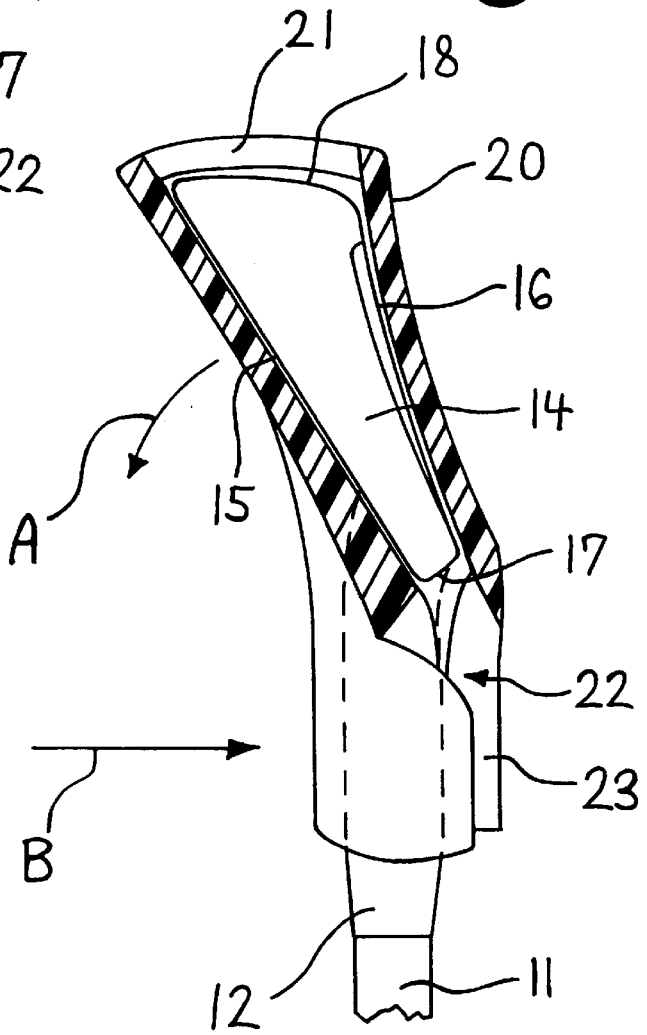
FIG. 5 is an elevation view of a high-loft golf club enclosed within a cover of the present invention with the cover cut away along line 5—5 of FIG. 3.

FIGS. 4 and 5 illustrate the correct location of the slot 22 respecting that portion of the cover 20 that conceals the neck 12 of the golf club head 10. At this part of the cover 20, the slot 22 is substantially opposite the direction of force that a high-loft club would impose on the neck 12 via the cover 20. FIG. 4 shows the cover 20 on a golf club head 10 with a low club head loft angle. In FIG. 5, the cover 20 is shown on a golf club head 10 with a high loft angle. The high loft of the golf club head 10 exerts pressure on the inside of the cover 20 in a direction of arrow "A" which, in turn, forces the cover 20 against the neck 12 of the golf club head 10. The force against the neck 12 is represented by arrow "B".

To take advantage of the force against the neck 12, the slot 22 runs down the side of the neck that is substantially opposite the force illustrated by arrow "B". In this way, the force illustrated by arrow "B" does not distort the slot 22 detrimentally; rather, it helps hold the cover 20 on the golf club head 10.

In the preferred embodiment, the cover 20 would be shaped to generally match a golf club with a low loft angle. This same cover 20 will then also work with clubs having higher loft angles. The inner cavity should be large enough to accommodate the club head of every iron in a given set. Because each iron will have a neck that is substantially similar in dimensions to that of all other irons in the set, the portion of the cover 20 that encloses the neck will fit the same on each separate club.

OPERATION (FIG.6)

Figure 6:
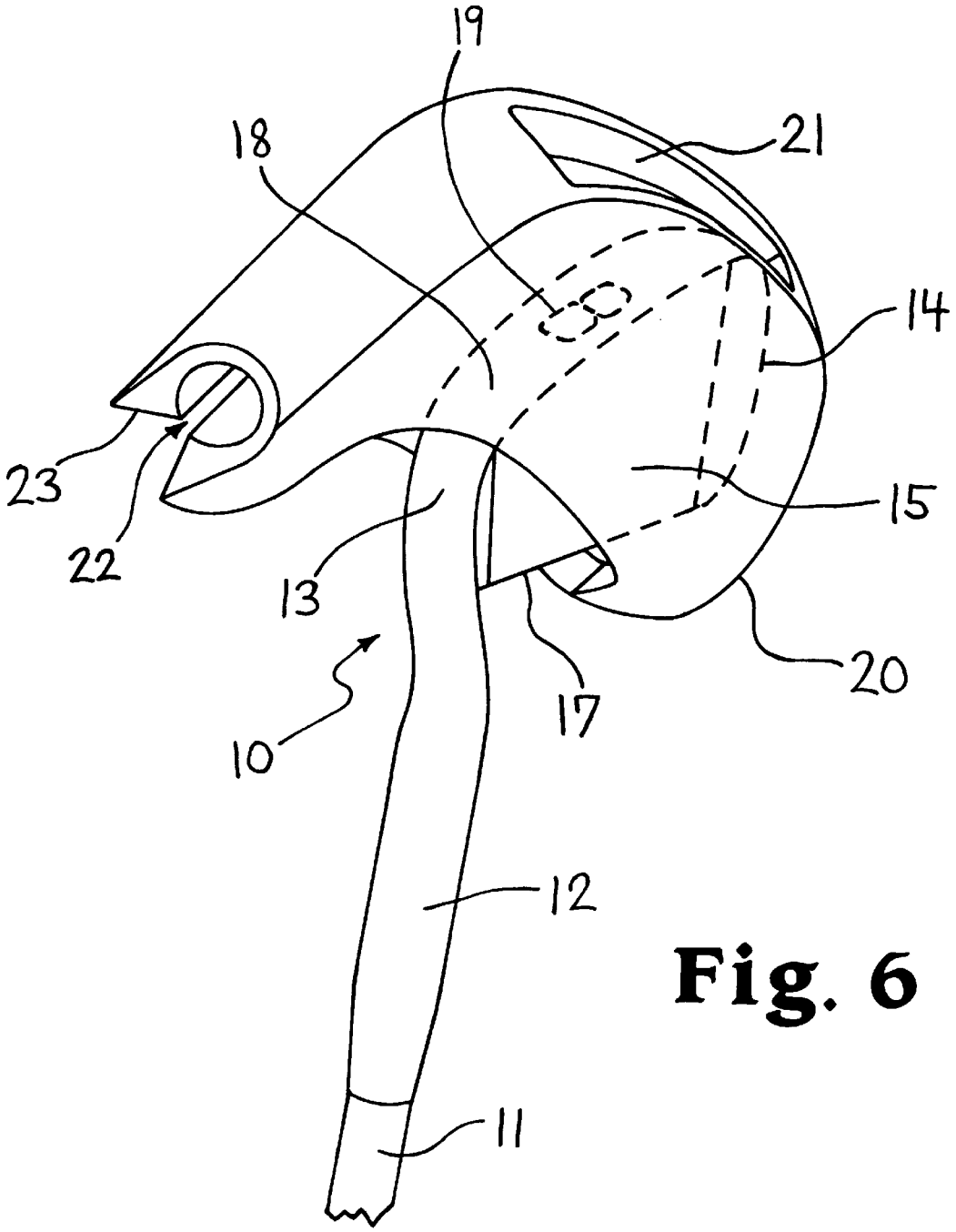
FIG. 6 is a perspective view illustrating a golf club head partially within a cover of the present invention.

To place the cover 20 on a golf club head 10, a user inserts the toe 14 into the slot 22 as illustrated in FIG. 6. The flared edges 23 will assist the user in opening the slot 22. When the cover 20 is pressed onto the neck 12 of the golf club head 10, the cover 20 will be secured in place and the identification marking 19 will be viewable through the aperture 21.

To remove the cover 20, a user would follow the opposite of this procedure.

SUMMARY, RAMIFICATIONS, AND SCOPE

The above description offers a true "one size fits all" golf club head cover that is easy to use and can be economically manufactured. However, although the description is specific in many respects, it is intended as an explanation of the preferred embodiment as opposed to a limitation on the invention. For example, a cover of the present invention could be produced from a variety of materials. Thus, the scope of the invention should be determined by the appended claims and their legal equivalents rather than by the examples given.

I claim:

1. A cover for a golf club, the golf club including a golf club head marked with identification markings and a shaft extending therefrom, comprising:

a hood for substantially surrounding the golf club head;

a fixed aperture on the hood, the aperture being completely open without a transparent or translucent membrane of any kind and positioned such that, when the cover is in position on the golf club head, the identification markings can be viewed through the aperture.

2. A cover for a golf club, the golf club including a shaft extending from a golf club head, the golf club head including a face portion, a top edge portion, a sole portion, and a neck portion;

the top edge portion being substantially opposite the sole portion;

the cover comprising a hood that substantially covers the golf club head;

the hood including a slot that allows passage of the golf club head into the hood;

the slot beginning at that part of the hood that conceals the top edge portion of the golf club head;

the slot continuing through that part of the hood that conceals the neck portion of the golf club head;

the slot configured such that it runs down the side of the neck portion that is substantially opposite the face portion of the golf club head.

3. The cover described in claim 2, wherein:

the slot includes flared edges to assist a user in placing the cover on the golf club head.

* * * * *